US009982508B2

(12) United States Patent
Murphree et al.

(10) Patent No.: US 9,982,508 B2
(45) Date of Patent: May 29, 2018

(54) INTERVENTION TOOL FOR DELIVERING SELF-ASSEMBLING REPAIR FLUID

(71) Applicant: HALLIBURTON ENERGY SERVICES, INC., Houston, TX (US)

(72) Inventors: Zachary Ryan Murphree, Dallas, TX (US); Michael Linley Fripp, Carrollton, TX (US); Thomas Jules Frosell, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 271 days.

(21) Appl. No.: 14/655,851

(22) PCT Filed: Dec. 19, 2013

(86) PCT No.: PCT/US2013/076505
§ 371 (c)(1),
(2) Date: Jun. 26, 2015

(87) PCT Pub. No.: WO2015/094274
PCT Pub. Date: Jun. 25, 2015

(65) Prior Publication Data

US 2015/0345250 A1 Dec. 3, 2015

(51) Int. Cl.

| | |
|---|---|
| ***E21B 33/10*** | (2006.01) |
| ***E21B 43/08*** | (2006.01) |
| ***C09K 8/50*** | (2006.01) |
| ***E21B 33/138*** | (2006.01) |
| ***E21B 43/25*** | (2006.01) |
| ***E21B 43/14*** | (2006.01) |

(52) U.S. Cl.
CPC ..... *E21B 33/138* (2013.01); *E21B 43/08* (2013.01); *E21B 43/14* (2013.01); *E21B 43/25* (2013.01)

(58) Field of Classification Search
CPC ..... E21B 33/10; E21B 33/00; E21B 43/08; E21B 29/10; C09K 8/42; C09K 8/422; C09K 8/467; C09K 8/50
(Continued)

(56) References Cited

U.S. PATENT DOCUMENTS 3,052,297 A * 9/1962 Blydorp ..... E21B 33/134 166/136
3,984,918 A 10/1976 Chaney
(Continued)

FOREIGN PATENT DOCUMENTS

GB 2222680 3/1990
PL 397294 6/2013
(Continued)

OTHER PUBLICATIONS

Australian Application No. 2013408294, First Examination Report dated Jul. 1, 2016, 3 pages.
(Continued)

*Primary Examiner* — Kenneth L Thompson
(74) *Attorney, Agent, or Firm* — Kilpatrick Townsend & Stockton LLP

(57) ABSTRACT

Certain aspects are directed to devices for use in a wellbore in a subterranean formation. There is provided an intervention tool that may be used to set a self-assembling remedial screen, patch, plug, create a remedial isolation zone, conduct remedial securement, or otherwise provide a remedial fix to one or more components of the completion in a downhole configuration. The intervention tool may have a tool shaft, at least two magnets positioned with respect to the tool shaft, a carrier fluid containing magnetically responsive particles, one or more injection ports on the tool shaft, and a fluid deployment system to cause deployment of the carrier fluid out of the tool shaft through the one or more injection ports.

24 Claims, 7 Drawing Sheets

(58) Field of Classification Search
USPC ..... 166/66.5, 277, 387
See application file for complete search history.

(56) References Cited

U.S. PATENT DOCUMENTS 4,035,718 A 7/1977 Chandler
4,222,444 A * 9/1980 Hamilton ..... C09K 8/035 166/253.1
4,269,279 A * 5/1981 House ..... C09K 8/035 175/65
4,350,955 A 9/1982 Jackson
4,356,098 A 10/1982 Chagnon
4,424,974 A 1/1984 Mitsuya et al.
4,444,398 A 4/1984 Black et al.
4,502,700 A 3/1985 Gowda et al.
4,526,379 A 7/1985 Raj
4,604,222 A 8/1986 Borduz et al.
4,604,229 A 8/1986 Raj et al.
4,630,243 A 12/1986 MacLeod
4,630,943 A 12/1986 Stahl et al.
4,691,774 A 9/1987 Nelson
4,802,534 A * 2/1989 Larson ..... B01F 13/0809 166/285
4,845,988 A 7/1989 Russell et al.
4,865,334 A 9/1989 Raj et al.
4,991,438 A 2/1991 Evans
5,007,513 A 4/1991 Carlson
5,092,611 A 3/1992 Ehmsen et al.
5,429,000 A 7/1995 Raj et al.
5,452,520 A 9/1995 Raj et al.
5,474,302 A 12/1995 Black et al.
5,475,309 A 12/1995 Hong et al.
5,780,741 A 7/1998 Raj
5,850,624 A 12/1998 Gard et al.
6,216,787 B1 4/2001 Ruttley
6,250,848 B1 6/2001 Moridis et al.
6,257,356 B1 7/2001 Wassell
6,290,894 B1 9/2001 Raj et al.
6,305,694 B1 10/2001 Yamazumi et al.
6,681,849 B2 1/2004 Goodson, Jr.
6,817,415 B2 11/2004 Orban et al.
7,021,406 B2 4/2006 Zitha
7,032,670 B2 4/2006 Zitha
7,063,146 B2 6/2006 Schultz et al.
7,063,802 B2 6/2006 Tsuda et al.
7,159,675 B2 1/2007 Eigner et al.
7,204,581 B2 4/2007 Peeters
7,219,752 B2 5/2007 Wassell et al.
7,428,922 B2 9/2008 Fripp et al.
7,743,825 B2 6/2010 O'Malley et al.
7,763,175 B2 7/2010 DeCoster et al.
7,779,933 B2 8/2010 Sihler et al.
7,950,672 B2 5/2011 Shimazaki et al.
8,056,246 B1 11/2011 Hopper et al.
8,083,849 B2 * 12/2011 Lewis ..... G06F 3/1205 106/606
8,136,594 B2 3/2012 Streich et al.
8,230,918 B2 7/2012 Ameen
8,240,384 B2 * 8/2012 Miller ..... E21B 27/00 166/192
8,269,501 B2 9/2012 Schmidt et al.
8,286,705 B2 10/2012 Ocalan et al.
8,328,199 B2 12/2012 Oshita
8,342,244 B2 * 1/2013 Streich ..... C09K 8/42 166/285
8,360,170 B2 1/2013 Leuchtenberg
8,419,019 B2 4/2013 Kung
8,689,875 B2 4/2014 Dudley et al.
8,936,095 B2 * 1/2015 Ocalan ..... E21B 33/00 166/376
9,163,475 B2 * 10/2015 Meinke ..... E21B 33/00
9,206,659 B2 12/2015 Zhang et al.
9,512,698 B2 * 12/2016 Donderici ..... E21B 33/12
9,551,203 B2 1/2017 Meinke et al.
2003/0166470 A1 9/2003 Fripp et al.
2004/0084184 A1 5/2004 Orban et al.
2005/0006020 A1 * 1/2005 Jose Zitha ..... C04B 40/0209 156/71
2005/0109512 A1 * 5/2005 Zitha ..... C09K 8/5045 166/305.1
2005/0274524 A1 12/2005 Silguero et al.
2008/0290876 A1 11/2008 Ameen
2009/0008078 A1 1/2009 Patel
2009/0025928 A1 1/2009 Lee
2009/0101364 A1 4/2009 Schafer et al.
2009/0179385 A1 7/2009 Komino et al.
2010/0019514 A1 1/2010 Steinwender
2010/0126716 A1 5/2010 Joseph
2010/0224360 A1 9/2010 MacDougall et al.
2010/0267594 A1 10/2010 Rana et al.
2011/0056681 A1 3/2011 Khan
2011/0108277 A1 5/2011 Dudley et al.
2011/0121516 A1 * 5/2011 Hallundbæk ..... E21B 29/10 277/316
2011/0127727 A1 * 6/2011 Hallundbæk ..... C09K 3/12 277/316
2011/0186297 A1 8/2011 Zhang et al.
2011/0192573 A1 8/2011 Defretin et al.
2011/0284213 A1 * 11/2011 Willberg ..... E21B 33/1208 166/135
2011/0297265 A1 12/2011 Kahoe et al.
2011/0297394 A1 12/2011 VanDelden
2012/0325490 A1 * 12/2012 Ohta ..... E21B 43/0122 166/363
2013/0020066 A1 1/2013 Ocalan et al.
2013/0091941 A1 4/2013 Huh et al.
2013/0105224 A1 5/2013 Donderici et al.
2013/0112911 A1 5/2013 Mazyar et al.
2013/0119995 A1 5/2013 Wootten
2013/0139565 A1 6/2013 Hedtke
2013/0150267 A1 * 6/2013 Roddy ..... C04B 40/0641 507/103
2013/0161006 A1 * 6/2013 Robisson ..... E21B 33/1208 166/285
2013/0169278 A1 7/2013 Bittar et al.
2013/0199650 A1 8/2013 Cabot et al.
2014/0262268 A1 9/2014 Kageler
2015/0013985 A1 1/2015 Parsche
2015/0034332 A1 2/2015 Merron
2015/0315868 A1 * 11/2015 Fripp ..... E21B 33/10 166/387
2016/0010424 A1 * 1/2016 Van Oort ..... C04B 28/02 166/293
2016/0032688 A1 2/2016 Donderici et al.
2016/0040506 A1 2/2016 Goodman et al.
2016/0040507 A1 2/2016 Donderici et al.
2016/0047204 A1 2/2016 Donderici et al.
2016/0145968 A1 5/2016 Marya

FOREIGN PATENT DOCUMENTS

WO 2001061713 8/2001
WO 2005038189 4/2005
WO 2009142779 11/2009
WO 2011153524 12/2011
WO 2013012967 1/2013
WO 2015094266 6/2015
WO 2015102561 7/2015
WO 2015102563 7/2015
WO 2015102566 7/2015
WO 2015102568 7/2015

OTHER PUBLICATIONS

Australian Applcation No. AU2013408294, Second Examination Report dated Nov. 7, 2016, 4 pages.
United Kingdom Patent Application No. 1604646.8, Examination Report dated Feb. 24, 2017 (3 pages).
Dickstein et al., Labyrinthine Pattern Formation in Magnetic Fluids, Science, New Series, vol. 261, No. 5124, Aug. 20, 1993, pp. 1012-1015.

(56) References Cited

OTHER PUBLICATIONS

Gollwitzer et al., The Surface Topography of a Magnetic Fluid—A Quantitative Comparison Between Experiment and Numerical Simulation, Journal of Fluid Mechanics, May 2006, pp. 1-21.
Grundfos , The Centrifugal Pump, Company Datasheet, Dec. 2003, 128 pages.
Horak et al., Experimental and Numerical Determination of the Static Critical Pressure in Ferrofluid Seals, Journal of Physics: Conference Series, vol. 412, 2013, pp. 1-6.
Pant et al., Synthesis and characterization of ferrofluid-conducting polymer composite, Indian Journal of Engineering and Materials Sciences, vol. 11, Aug. 2004., pp. 267-270.
International Patent Application No. PCT/US2013/076505 , International Search Report and Written Opinion, dated Sep. 25, 2014, 14 pages.
Raj et al., Advances in ferrofluid technology, Journal of Magnetism and Magnetic Materials, vol. 149, 1995, pp. 174-180.
Rosenweig , Magnetic Fluid Motion in Rotating Field, Journal of Magnetism and Magnetic Materials, vol. 85, Issues 1-3, Apr. 1990, pp. 171-180.

* cited by examiner

INTERVENTION TOOL FOR DELIVERING SELF-ASSEMBLING REPAIR FLUID

CROSS-REFERENCE TO RELATED APPLICATIONS

This is a U.S. national phase under 35 U.S.C. § 371 of International Patent Application No. PCT/US2013/076505, titled "Intervention Tool for Delivering Self-Assembling Repair Fluid" and filed Dec. 19, 2013, the entirety of which incorporated herein by reference.

TECHNICAL FIELD OF THE DISCLOSURE

The present disclosure relates generally to devices for use in a wellbore in a subterranean formation and, more particularly (although not necessarily exclusively), to an intervention tool that may be used to set a self-assembling remedial screen, patch, plug, create a remedial isolation zone, conduct remedial securement, or otherwise provide a remedial fix to one or more components in a downhole configuration. It relates to an intervention tool that can create a seal or inject fluid through a completion.

BACKGROUND

Various devices can be utilized in a well that traverses a hydrocarbon-bearing subterranean formation. In many instances, it may be desirable to divide a subterranean formation into zones and to isolate those zones from one another in order to prevent cross-flow of fluids from the rock formation and other areas into the annulus. There are in-flow control devices that may be used to balance production, for example, to prevent all production from one zone of the well. Without such devices, the zone may produce sand, be subject to erosion, water breakthrough, or other detrimental problems.

For example, a packer device may be installed along production tubing in the well. Expansion of an elastomeric element may cause the packer to expand and restrict the flow of fluid through an annulus between the packer and the tubing. Packers are set when the completion is run in. However, there are other instances when one or more zones of a well may need to be separated or blocked off during remedial work.

Zones may also be separated by one or more screens. For example, screens may be used to control the migration of formation sands into production tubulars and surface equipment, which can cause washouts and other problems, particularly from unconsolidated sand formations of offshore fields. In a gravel pack, fluids may be used to carry gravel from the surface and deposit the gravel in the annulus between a sand-control screen and the wellbore. This may help hold formation sand in place. Formation fluid can flow through the gravel, the screen, and into the production pipe. Sometimes, the screens become damaged due to gravel pressure, erosion, or other forces or environmental conditions.

There are also in-flow control devices (ICD) that may be used to control undesired fluids from entering into production tubing. For example, an in-flow control device may be installed and combined with a sand screen in an unconsolidated reservoir. The reservoir fluid runs from the formation through the sand screen and into the flow chamber, where it continues through one or more tubes. The tube lengths and their inner diameters are generally designed to induce the appropriate pressure drop to move the flow through the pipe at a steady pace. The in-flow control device serves to equalize the pressure drop. The equalized pressure drop can yield a more efficient completion. Other in-flow control devices may be referred to as autonomous in-flow control devices (AICD). An AICD may be used when production causes unwanted gas and/or water to migrate to the wellbore. An AICD may be used when uneven production distribution results due to pressure drop in the tubing. An AICD works initially like a passive ICD, yet it restricts the production of water and gas at breakthrough to minimize water and gas cuts.

Although packers, screens, and in-flow control systems are often run in on the completion, there are instances when revision or remedial work needs to be done on the components after they have already been set.

DETAILED DESCRIPTION

Figure 4:
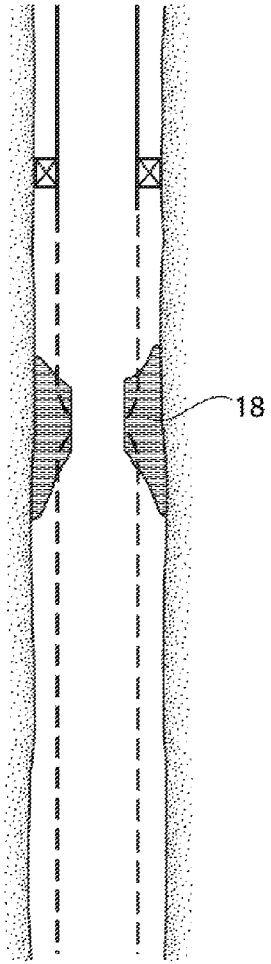
FIG. 4 shows the sealed screen section after removal of the tool.

Certain aspects and examples of the present disclosure are directed to a service tool (which may also referred to as an "intervention tool," a running tool, or any other tool that can be run downhole after a completion has been set). The intervention tool may function as a service tool that may be run down the completion through production casing. The intervention tool may carry a fluid that is used to create a seal or remedial patch. The intervention tool has certain features that allow it to deploy the fluid and to maintain the fluid in place while the fluid cures, sets, or otherwise hardens.

In one aspect, the intervention tool is used to carry a fluid filled with magnetically responsive particles (i.e., a magnetorheological fluid). The fluid generally includes a carrier fluid and the magnetically responsive particles. The fluid may be viscous so that it has certain and various flow properties. The intervention tool is designed to carry the fluid to the downhole location that needs a remedial fix. When the fluid is deployed from the tool, one or more magnets on the intervention tool attract the magnetically responsive particles. The magnetic attraction between the fluid and the magnets slows movement of the fluid. This slowing of the movement of fluid generally helps maintain the fluid in the desired space between the magnets. The magnets essentially "hold" the fluid in pace by virtue of the magnetic attraction between the magnetically responsive particles in the fluid and the magnets. This allows a seal or remedial patch to be formed.

Co-pending Application No. PCT/US2013/076456, titled "Self-Assembling Packer" discloses a self-assembling packer that can be deployed using this magnetic technology. For instance, the self-assembling packer components can be run in on a tubing string that is a part of the components initially conveyed downhole on the completion. The packer is generally a self-assembling packer that is created by injecting a fluid filled with magnetically responsive particles into an annulus between a pair of magnets positioned on a tubing. When a magnetic field passes through the fluid, the particles align with a magnetic field created by the magnets, such that the particles hold the carrier fluid between magnets. Once the carrier fluid is allowed to cure and harden, the resulting material functions as a packer. This allows the packer to be set without using a hydraulic squeeze or other forces typically used to form a packer.

However, in addition to instances when a packer needs to be set during a completion, there are also instances when a remedial seal needs to be positioned during a workover, for example, on a wireline, slickline, coiled-tubing, jointed tubing, or other line during later remedial work after the completion has already been run. Aspects of this disclosure are thus related to providing an intervention tool that allows the self-assembling packer technology to be applied to situations that require or benefit from remedial work. This disclosure accordingly provides methods of locally controlling the axial flow of fluid (e.g., a carrier fluid with the magnetically responsive particles) that has been injected downhole.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present disclosure.

In one aspect, it may be desirable to provide an intervention tool that can convey a magnetorheological fluid downhole. The fluid may be used to create a seal that acts to close off or "glue" or otherwise repair a damaged area. For instance, the fluid may be used to fix a damaged section of screen by locally plugging the screen with a sealant. The fluid may be used to plug a water inflow area in a producing zone of the wellbore. The fluid may be used to block an in-flow control device (ICD or AICD) flow path to selectively stop zone production of a zone. The fluid may be used to create a remedial fix or otherwise locally secure a section of the completion. These are only non-limiting examples of potential uses for the fluid downhole; other uses are possible and considered within the scope of this disclosure.

More specifically, in one aspect, the intervention tool may be used to convey a magnetorheological fluid sealant downhole. Constraining magnets on the tool serve to "freeze" the fluid sealant at the desired location due to magnetic forces between magnetically responsive particles in the sealant and a magnetic field created by the tool. When the tool is positioned at the location where the remedial work is to be performed, the fluid sealant is injected, and the tool remains in place so that constraining magnets will constrain the axial flow of the fluid sealant until it is set. Once the sealant has set, the tool can be removed.

Figure 2:
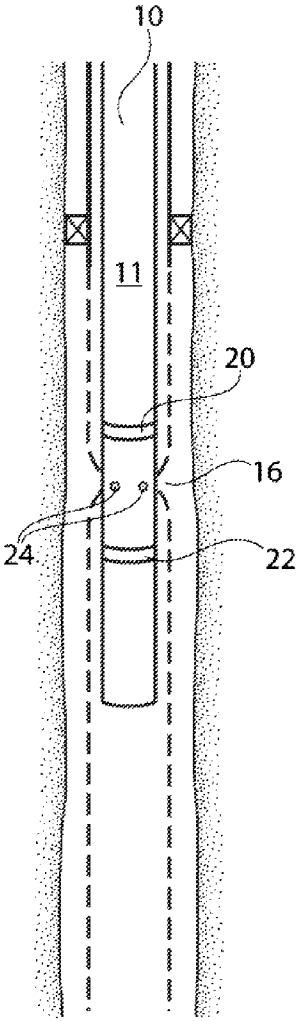
FIG. 2 shows a side view of an intervention tool being delivered to the damaged screen section.
Figure 1:
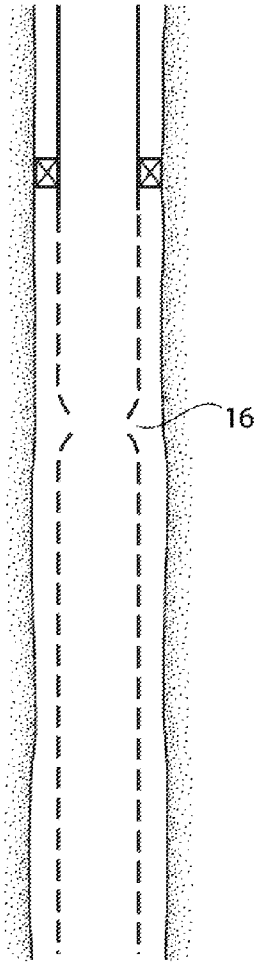
FIG. 1 shows a side view of a wellbore with a damaged screen section.

FIGS. 1-4 show an intervention tool 10 as it may be used to fix a damaged screen section 16 by locally plugging the screen with a sealant. FIG. 1 is side view of a wellbore with a damaged screen section 16. FIG. 2 shows a side view of an intervention tool 10 being delivered to the damaged screen section 16. This figure shows the tool 10 as it conveys the fluid 12 downhole, with magnetic components 20, 22 on the running tool 10. The tool 10 may be run in on wireline, slickline, coiled tube, jointed tubing, or any other appropriate system to the location of the damage.

Figure 3:
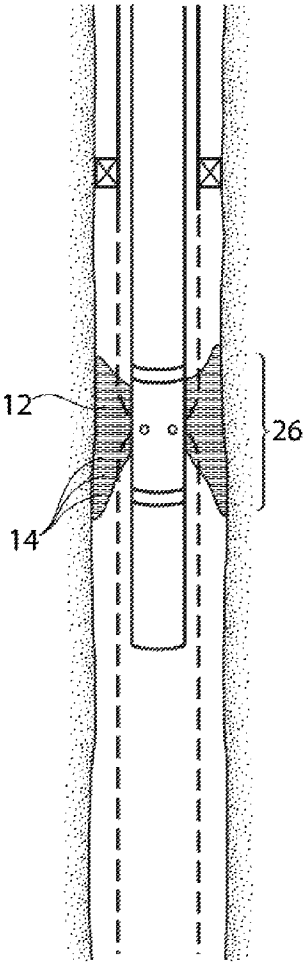
FIG. 3 shows a side view of fluid being delivered to repair the damaged screen section by creating a seal.

The tool 10 generally has a shaft 11 that can be delivered downhole. When the tool 10 has reached the location where the fluid 12 is to be injected, the fluid 12 is caused to be pushed out of the tool 10 through injection ports 24. FIG. 3 shows a side view of fluid 12 being delivered to the damaged screen 16 section to create a seal. FIG. 4 shows the seal 18 created on the screen section after removal of the tool 10.

In one aspect, the fluid 12 delivered is generally a carrier fluid 12 that is a magnetorheological fluid, ferrofluid, or a fluid otherwise having magnetically responsive particles 14 contained therein. The fluid 12 can generally be a fluid to which its resistance to flow is modified by subjecting it to a magnetic field. The carrier fluid 12 may be formed from magnetically responsive particles 14 and a carrier to form a slurry. In one aspect, the fluid 12 contains magnetically responsive particles 14 of a ferromagnetic material, such as iron, nickel, cobalt, any ferromagnetic, diamagnetic or paramagnetic particles, ferromagnetic particles, any combination thereof, or any other particles that can receive and react to a magnetic force. Any particles 14 that are attracted to magnets can be used in the fluid 12 and are considered within the scope of this disclosure. (It should be noted that the figures are not drawn to scale and for illustrative purposes only. For example, the particles 14 are not easily visible due to their small size, and they have thus been exaggerated in the figures for ease of viewing.)

Any suitable particle size can be used for the particles 14 of the fluid 12. For example, the nanoparticles may range from the nanometer size up to the micrometer size. In one example, the particles may be in the size range of about 100 nanometers to about 1000 nanometers. In another example, the particles may be less than 100 nanometers. In another example, the particles may range into the micrometer size, for example up to about 100 microns. It should be understood that other particles sizes are possible and considered within the scope of this disclosure. In embodiments where the particles are referred to as "nanoparticles," it should be understood that the particles may also be of micron sizes, or a combination of nanoparticles and microparticles. The particles 14 can also be any shape, non-limiting examples of which include spheres, spheroids, tubular, corpuscular, fiber, oblate spheroids, or any other appropriate shape. Multiple shapes and multiple sizes may be combined in a single group of particles 14.

The shape of the actual particles may be altered in an effort to create better internal locking of the particles. For example, round particles may be used. However, elongated or rod-shaped particles may lock more securely and create a stronger packer in place. The particles can be shaped to better entangle with one another to form the packer. The length of the particles may also be modified to provide varying locking configurations. It is believed that a particularly useful length may be from about 10 nanometers to about 1 millimeter, although other options are possible and within the scope of this disclosure.

The fluid 12 may generally be formed from magnetically responsive particles 14 that are mixed into a carrier fluid. Any suitable carrier fluid may be used that can contain the magnetically responsive particles 14, allow a flow of the particles 14, and can be used to form a seal 18. In a specific aspect, the carrier fluid is a polymer precursor. The polymer precursor may be a material that forms cross-links. Non-limiting examples of polymer precursors that may be used in connection with this disclosure include but are not limited to plastics, adhesives, thermoplastics, thermosetting resins, elastomeric materials, polymers, epoxies, silicones, sealants, oils, gels, glues, acids, thixotropic fluids, dilatant fluids, or any combinations thereof. The polymer precursor may be a single part (for example, a moisture or UV cure silicone). Alternatively, the polymer precursor may be a multi-part (for example, a vinyl addition or a platinum catalyst cure silicone) system.

The polymer precursor should generally be a material that can carry magnetically responsive particles 14 and cure or otherwise set upon appropriate forces, environmental conditions, or time. The polymer precursor should be a material that can create a seal. The polymer precursor should be a material that can be carried downhole on the tool 10 and activated or otherwise mixed downhole. For example, a material that has a requirement of being mixed at the surface and pumped downhole, such as cement, is not preferable. Polymer precursors provide the feature of being deliverable downhole without having to be activated for immediate use. Any other type of polymer precursor or other material that may act as a carrier for magnetically responsive particles 14 and that can cure to form a seal or otherwise act as a sealant is generally considered within the scope of this disclosure.

The carrier fluid 12 can form a seal or otherwise act as a sealant in response to appropriate forces, environmental conditions, or time. One non-limiting example of a suitable carrier fluid includes an epoxy. Other non-limiting examples of suitable carriers include one-part or multi-part systems. One specific option could be a one-part or a multi-part epoxy. Other non-limiting examples of a suitable carrier fluid include silicones, oils, polymers, gels, elastomeric materials, glues, sealants, water, soap, acids, fusible metals, thixotropic fluids, dilatant fluids, any combination thereof, or any other fluid that can contain the nanoparticles and allow their flow but create an ultimate seal. Any material that may act as a carrier for the particles 14 and that can solidify, cure, or harden (to form a seal or otherwise act as a sealant upon appropriate forces, environmental conditions, or time) is possible for use and considered within the scope of this disclosure.

In some aspects, the carrier may be formed in multiple steps. For example, an epoxy may be used that has a two-part set-up (for example, a two-part epoxy), where parts A and B are housed separately from one another and mixed as they pass through a static mixer on their way to the damaged area to be repaired. In another aspect, the particles 14 may be in one part of fluid and another part of the carrier fluid may be in a second part, such that the two (or more) parts are combined upon dispensing.

The tool contains the carrier fluid 12 therein. In one aspect, the carrier fluid 12 may be housed in a housing with a delivery conduit. The housing may house the carrier fluid 12 in a pre-combined condition. Alternatively, the housing may be designed to maintain parts A and B of carrier fluid 12 separately until just prior to deployment of the carrier fluid 12. For example, there may be provided a divider wall within housing to maintain parts of the polymer precursor of the carrier fluid 12 separate from one another until deployment.

As shown in FIGS. 2 and 3, the tool 10 may have a pair of magnet rings 20, 22. Magnet rings 20, 22 may encircle the outside diameter of the tool shaft 11, they may be positioned on the inner diameter of the tool 10, they may be embedded into the tool material, or otherwise. Magnets 20, 22 may be attached or otherwise secured to the tool 10 via any appropriate method. Non-limiting examples of appropriate methods include adhesives, welding, mechanical attachments, embedding the magnets within the tool material, or any other option. Additionally or alternatively, magnet components may be pre-installed on the completion, as described for further aspects below. The magnets can be either permanent magnets or electromagnets.

Although shown and described as rings 20, 22, the magnets may be magnetic blocks or any other shaped magnetic component that can be spaced apart on tool 10 and provide the desired functions of attracting the magnetically responsive particles 14 of the fluid 12. For example, although two magnet rings 20, 22 are shown for ease of reference, it should be understood that magnet rings 20, 22 may be a series of individual magnets positioned in a ring around the area to be made magnetic. The general concept is that magnets 20, 22 form a magnetic space therebetween that extends radially from the tool 10. The magnetic space extends past the outer diameter of the tool.

The features described may also work on the principle of electro-rheological fluid, where the fluid responds to electrical fields that are produced by a component(s) on the running tool, on the completion, or both.

The tool may also have one or more fluid injection ports 24. The one or more injection ports 24 carry the fluid 12 from the interior of the tool 10 to the desired target area. In one aspect, the injection ports 24 may be sealed or otherwise covered by a component that prevents the carrier fluid 12 from exiting the tool 10 until desired. On one aspect, a rupture disc may be provided, which ruptures upon application of pressure. The carrier fluid 12 may be deployed through the tool via any appropriate method, such a pressure from a piston or any other component or force that can apply pressure to the fluid 12.

In one aspect, the rupture disc may be a small piece of foil, metal, or other material that contains the fluid 12 inside the intervention tool 10 until pressure is applied. In another aspect, the rupture disc may be a dissolvable plug that dissolves upon a certain pH environmental, or otherwise ceases to contain the fluid 12 in response to a pre-selected trigger. For example, the rupture disc may be formed as a temperature sensitive material or shape memory material plug that dissolves upon a certain temperature, shrinks or enlarges at a certain environmental condition, or otherwise ceases to contain the fluid 12 in response to a pre-selected trigger. For example, the dissolving of plug could cause a piston to push the fluid 12 out the created opening.

In additional or alternate aspects, a passive deployment of the rupture disc can allow the fluid 12 to disperse to the target area. For example, an electronically triggered system may be used to activate the release of the fluid. The fluid 12 may be pushed out through injection port 24 by a downhole power unit (DPU), an electronic rupture disc (ERD), hydrostatic pressure, a Ledoux-style or moyno-style hydraulic pump, or any other number of means. Any method or system that delivers fluid from the interior of the tool to the desired location near the damaged screen is envisioned with within the scope of this disclosure.

Once deployed, the carrier fluid 12 passes through a magnetic field created by magnets 20, 22. This causes the magnetically responsive particles 14 to align with the magnetic field created. This alignment causes the magnetically responsive particles 14 to hold the carrier fluid 12 between magnets 20, 22. The interaction between the particles 14 and the magnets 20, 22 allows the carrier fluid 12 to fill the space 26 between the magnets 20, 22 but prevents the fluid 12 from moving very far past the desired space 26.

This allows the fluid 12 to create a remedial screen patch or seal 18 by fixing the damaged section of screen 16 by locally plugging the damaged screen area with a sealant. The sealant (formed by the carrier fluid 12 and magnetically responsive particles 14) is pumped out of the tool 10, into the screen 16. The magnets 20, 22 constrain its axial flow. Once the sealant had set and the section of the screen 16 is no longer permeable or otherwise secured as desired, then the tool 10 can be removed.

The tool 10 may have an outer coating that allows an easy release of the tool from the cured or set sealant. The outer coating may be a Teflon® coating, a mold release coating, or any other type of coating that allows removal of tool 10 without disrupting the seal 18.

Figure 8:
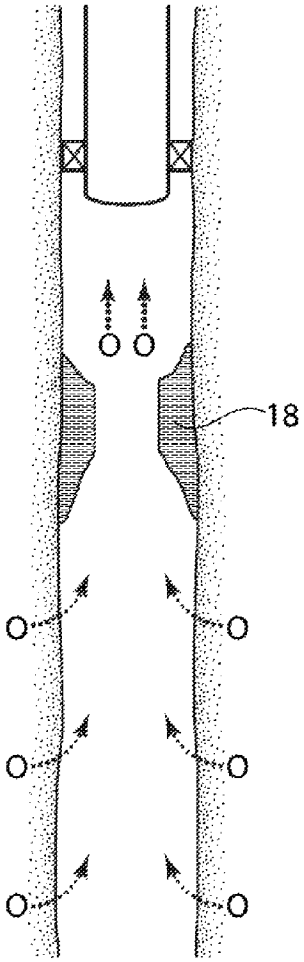
FIG. 8 shows the plugged area after removal of the tool.
Figure 7:
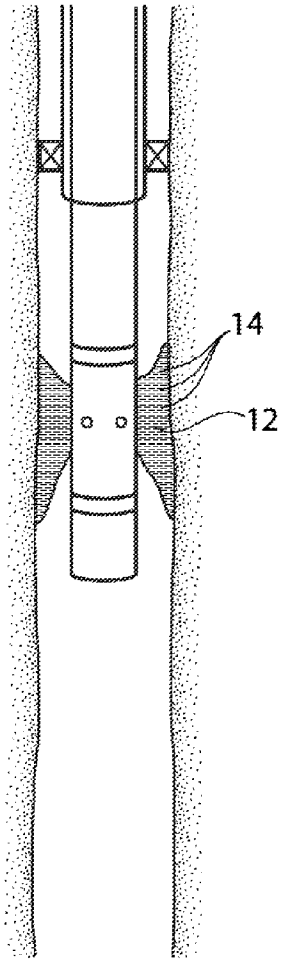
FIG. 7 shows a side view of fluid being delivered to the area to create a seal.
Figure 6:
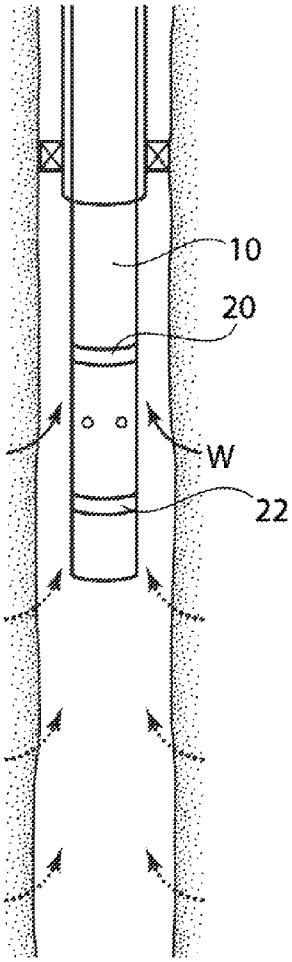
FIG. 6 shows a side view of an intervention tool being delivered to the area.
Figure 5:
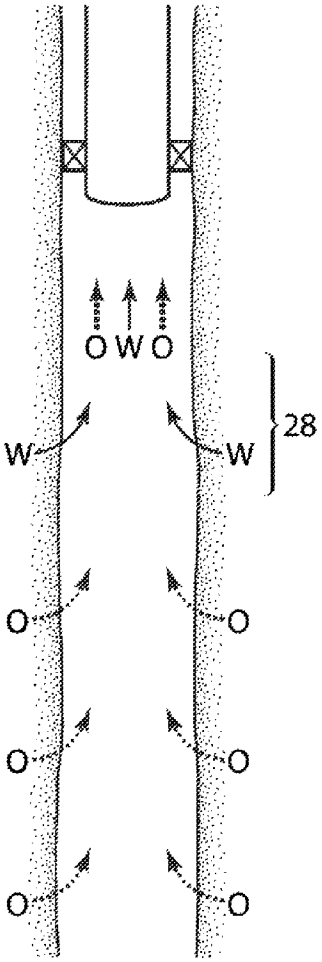
FIG. 5 shows a side view of a wellbore with a water inflow area that needs to be plugged.

In another embodiment, the tool 10 may be used to plug water inflow. One of the problems that can occur during the process of oil recovery from a formation is loss of the well's productivity at the onset of water inflow. Accordingly, it may be necessary to block and/or stop water producing zones. The tool 10 and its method of use described herein may be used to apply a sealant over an area 28 that is producing undesired water inflow, as shown by the solid arrows "W." The desired oil inflow is shown by dotted arrows "O." FIG. 5 shows a side view of a wellbore with a water inflow area 28 that needs to be plugged. FIG. 6 shows a side view of an intervention tool 10 being delivered to the area. FIG. 7 shows a side view of carrier fluid 12 being delivered to the area 28 to be sealed. FIG. 8 shows the sealed area after removal of the tool 10. This figure shows the stopped water "W" flow, but the continued oil "O" flow. In use, the magnets 20, 22 cause slowing and stoppage of the carrier fluid 12 due to interaction between magnetically responsive particles 14 and the magnets 20, 22. Once the seal has 18 been formed, the tool 10 is removed.

In one aspect, the self-contained remedial system extrudes a carrier fluid 12 that comprises either a sealant or a shear stress fluid over the location 28 of water production. The location of water production is shown by arrows W. The result is that flow from that water inflow area 28 zone is minimized. No more water W may flow into the production tubing. This is evidenced by the dotted arrows "O" in FIG. 8, which indicate the flow of oil but, not water, into the production tubing.

Figure 12:
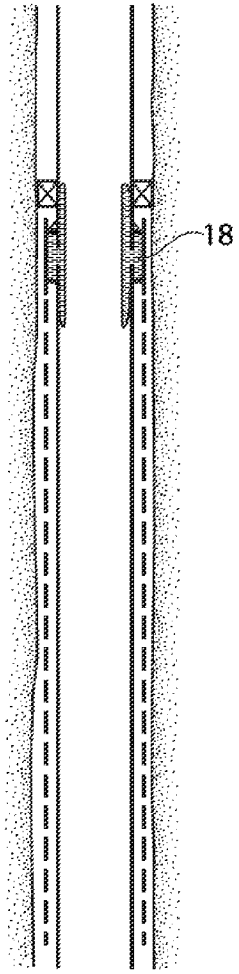
FIG. 12 shows the blocked in-flow control device after removal of the tool.
Figure 11:
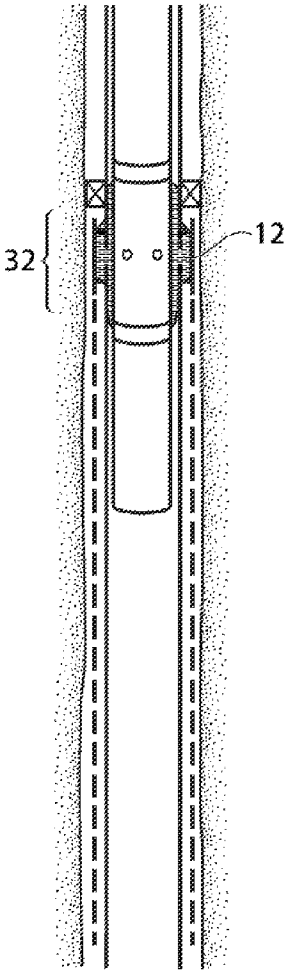
FIG. 11 shows a side view of fluid being delivered to the in-flow control device area to create a seal.
Figure 10:
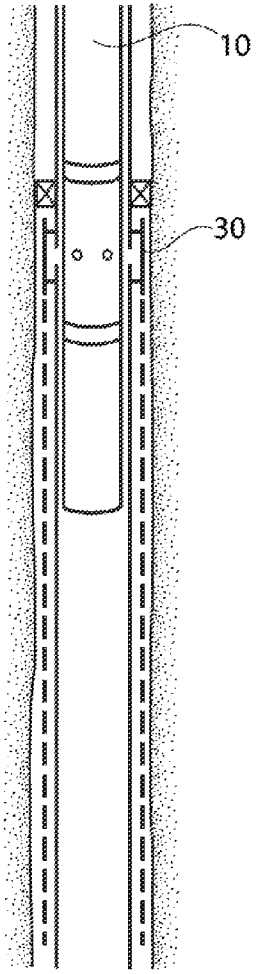
FIG. 10 shows a side view of an intervention tool being delivered to the in-flow control device area.
Figure 9:
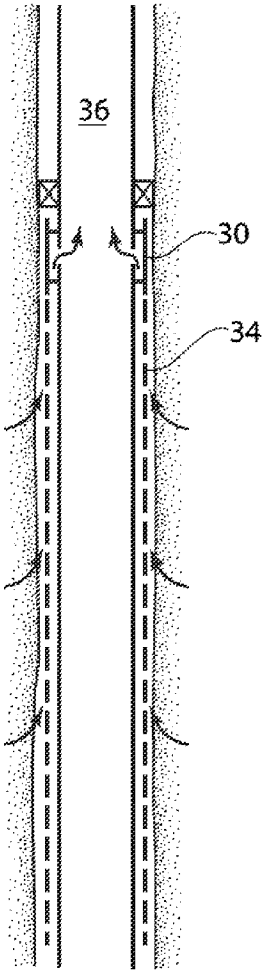
FIG. 9 shows a side view of a wellbore with a water in-flow control device that may be malfunctioning and need to be blocked.

In a related aspect, it may be necessary to block an in-flow device (ICD and/or an AICD) 30 flow path. As shown in FIGS. 9-12, the intervention tool 10 could be used to selectively stop production of a zone with an ICD/AICD 30 control by squeezing a sealant fluid 12 into the ICD/AICD flow path 32. FIG. 9 is side view of a wellbore with a water in-flow control device 30 that is malfunctioning and should be blocked. The produced fluid travels through the screen 34, through an ICD/AICD 30, and into the production tubing 36. FIG. 10 shows a side view of an intervention tool 10 being delivered through the production tubing 36 and to the in-flow control device area 30. FIG. 11 shows a side view of carrier fluid 12 being delivered to the in-flow control device flow path 32 to be blocked to create a seal 18. FIG. 12 shows the blocked in-flow control device 30 with a seal 18, after removal of the tool. This shows that once the fluid 12 (which may be an epoxy, a polymer precursor, or other sealant substance with magnetically responsive particles) is deployed or extruded out of the tool 10, the tool 10 may be removed. The result is that the blocked zone would no longer produce. This would allow an ICD/AICD 30 to be switched off, instead of simply limiting flow.

Another aspect could be to provide remedial zonal isolation. The tool 10 may be run inside of a section of screens. In this aspect, the tool 10 could be used to isolate different zones within those screens that would otherwise be in communication outside of the completion. This is similar to the remedial screen path concept described above, but with a different intent. In this instance, there is no damage to the screen that is being fixed with the seal. Instead, the fluid 12 is pumped to isolate the production in the top part of the screen from that of the bottom part. This can prevent fluid communication in the outer annulus between these two zones.

Figure 16:
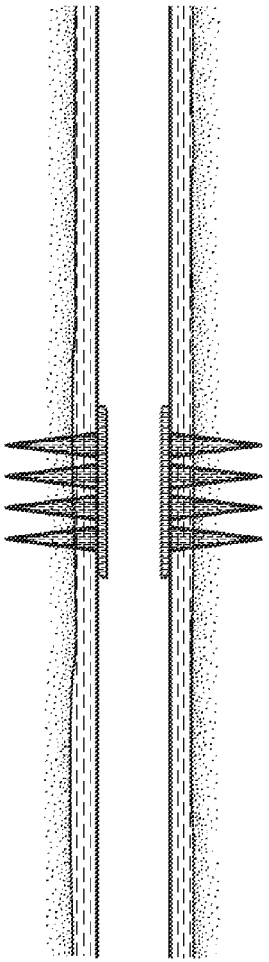
FIG. 16 shows the sealed perforations after removal of the tool.
Figure 15:
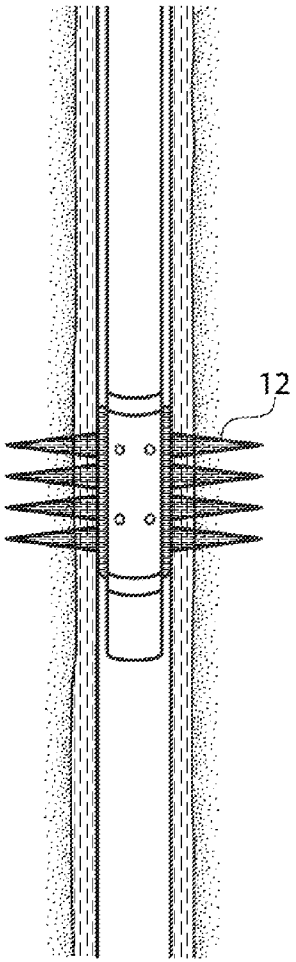
FIG. 15 shows a side view of fluid being delivered into the perforations to create remedial securement.
Figure 14:
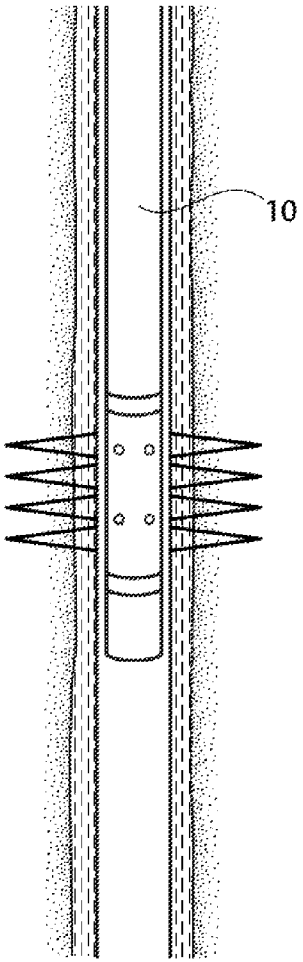
FIG. 14 shows a side view of an intervention tool being delivered to the perforation area.
Figure 13:
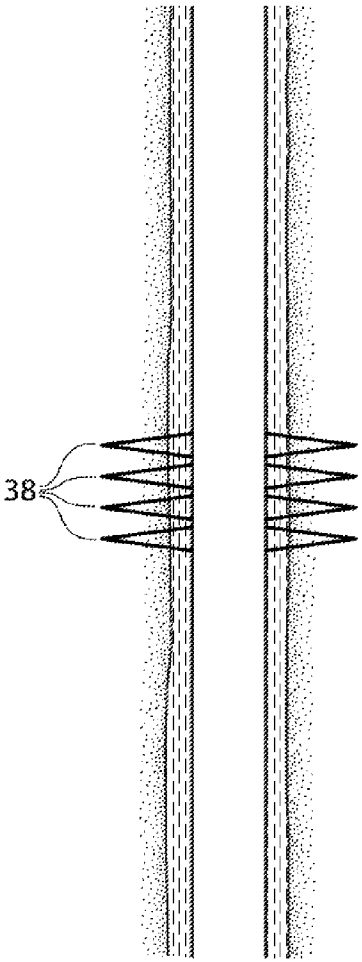
FIG. 13 shows a side view of a wellbore with perforations to be plugged.

A further aspect provides remedial securement. For example, the tool 10 could be used to locally secure a section of the completion. For instance, it is possible to use the tool 10 for plugging perforations 38 or as a remedial securing system. FIG. 13 shows side view of a wellbore with perforations 38 to be plugged. FIG. 14 shows a side view of an intervention tool 10 being delivered to the perforation area. FIG. 15 shows a side view of carrier fluid 12 being delivered into the perforations 38 to create remedial securement. FIG. 16 shows the sealed perforations after removal of the tool.

In any of the aspects described, once the carrier fluid 12 has been positioned as desired, the fluid 12 is allowed to cure or harden or otherwise create a seal. The polymer precursor material of the carrier fluid 12 may begin to cross-link and cure. For example, the passage of time, applied heat, and/or exposure to certain fluids or environments causes the carrier fluid 12 to set and/or cure to form a packer 10 in the desired location. For example, a elastomeric carrier may cure via vulcanization. A one-part epoxy may cure after a time being exposed to the wellbore fluids. A silicone sealant could be used as a one-part epoxy which sets and cures with exposure to water. A slow setting gel or other gel may set in the presence of water. Two-part systems generally cure due to a chemical reaction between the components to the two parts upon mixing. Other carriers/sealants may be used that cure based on temperature or any other environmental cue.

Further aspects, alternate options, and possible alterations to the above-disclosure are also possible. For example, the carrier fluid 12 may be selected so that it has self-healing properties that will provide a self-healing seal. For example, silicone sealants have been shown to have self-healing properties. Carrier fluids that set into a self-healing material may be advantageous for repairing damage from over-flexing, over-pressurization, tubing movement, and so forth. Self-healing can further be accomplished by adding an encapsulated healing agent and catalyst into the mix. Crack formation would rupture the encapsulated healing agent which would seal the crack. Using hollow glass fibers may also provide a self-healing packer element.

Additionally, in the above-described aspects, deployment of the carrier fluid 12 is accomplished by generally forcing the carrier fluid into the area to be sealed. Alternatively, the solution of particles could be encased in a dissolvable bladder or bag. When the bladder dissolves or degrades, the particles may be attracted toward the magnets. The particle solution can be encased in a water-dissolvable case with a material such as polyglycolic acid (PGA), polylactic acid (PLA), salt, sugar, or other water-dissolvable (or other solution-dissolvable, such as acid or brine contact) material. The reactions could be triggered by contact with water, acid, or brine solution. Additionally or alternatively, the carrier fluid 12 can be encased in a temperature-degradable case with a material such as a fusible metal, a low-melt thermoplastic, or an aluminum or magnesium case that would galvanically react in the water. Applied voltages may be used to cause the galvanic reaction to happen nearly instantaneously and/or voltage could be used to delay the galvanic reaction.

Although some methods and aspects have been described above, the general steps and methods described for use of the intervention tool 10 may be used for remedial work anywhere along the wellbore once the completion has been run.

Additionally or alternatively, a further aspect provides pre-placed magnets on the completion. The pre-placed magnet feature may be used with the intervention tool 10 as shown and described above, which has magnets 20, 22 positioned thereon. Additionally or alternatively, pre-placed magnets on the completion may be used with a delivery/service tool that can deliver the fluid 12 but that does not have magnets positioned thereon. For example, in one aspect, one or more magnets may be installed on pre-determined locations of the completion before the completion is run into the well. As an example, if zonal isolation is required between two sections of screen, magnetic barriers could be pre-installed between the sections of screen. One or more injection ports could be installed between the magnets. This provides the possibly for creating a seal through the screens if that becomes necessary. For example, the magnetic field can be created with one or more magnets incorporated into the screens during assembly. Additionally or alternatively, if an intervention tool with magnets is used, the magnetic field could permeate through the screens from the inner diameter of the tool 10.

Figure 17:
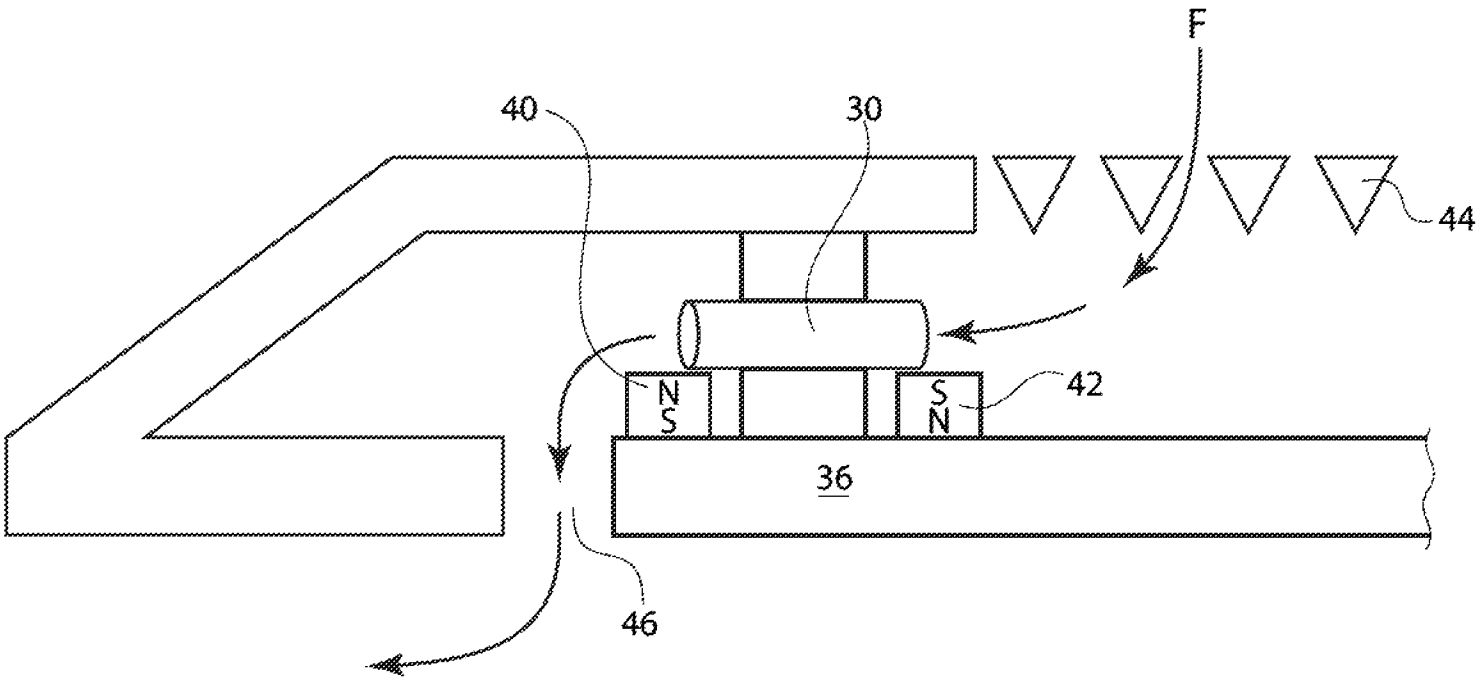
FIG. 17 shows a side view of a completion with an ICD/AICD on a completion having magnets pre-placed alongside.

As another example, magnets 40, 42 may be pre-positioned on either side of an ICD/AICD 30. FIG. 17 shows a side view of a completion with an ICD/AICD 30 having magnets pre-placed alongside. This would allow the later option of delivering a carrier fluid 12 to that area in order to block the ICD/AICD 30 if needed. Formation fluid "F" is shown flowing through the formation wall 44, into the ICD or AICD 30, and into an opening 46 in the production tubing 36. If the carrier fluid 12 is delivered into the opening 46, it would effectively block the function of the ICD/AICD 30. In this example, the carrier fluid 12 may be drawn into the ICD/AICD 30. By providing magnets 40, 42 on the completion 36 instead of on the running tool 10 (as previously described), traditional packer elements may be relied on to constrain the fluid motion between the tool 10 and the completion 36. The magnets 40, 42 may provide the axial flow constraint external to the completion.

Figure 18:
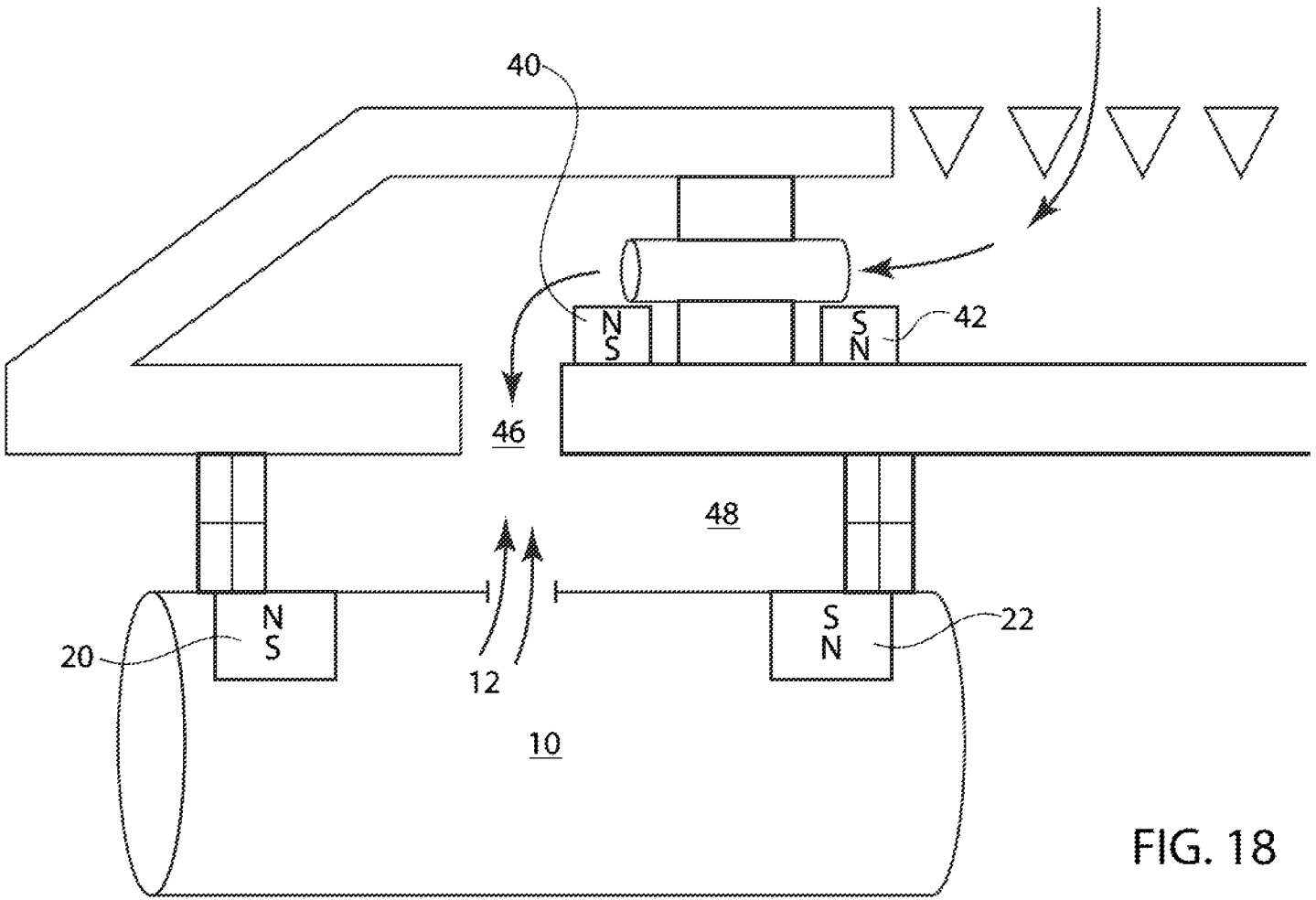
FIG. 18 shows a side view of FIG. 17 with an intervention tool in use.

In an further aspect, magnets 40, 42 may be positioned on the completion, as well as on an intervention tool 10. This option is illustrated by FIG. 18. FIG. 18 shows a side view of FIG. 17 with an intervention tool 10 having magnets 20, 22 positioned thereon in use. This figure illustrates an intervention tool 10 that is configured to inject fluid 12 into a desired space 48 (e.g., between the tool 10 and the completion). Magnets 20, 22 on the tool 10 can constrain the carrier fluid 12 to form a seal in the desired space 48. In this example, the carrier fluid 12 would form a seal in the space 48 between magnets 20, 22 on the tool 10 in order to block the opening 46 in the completion.

Figure 19:
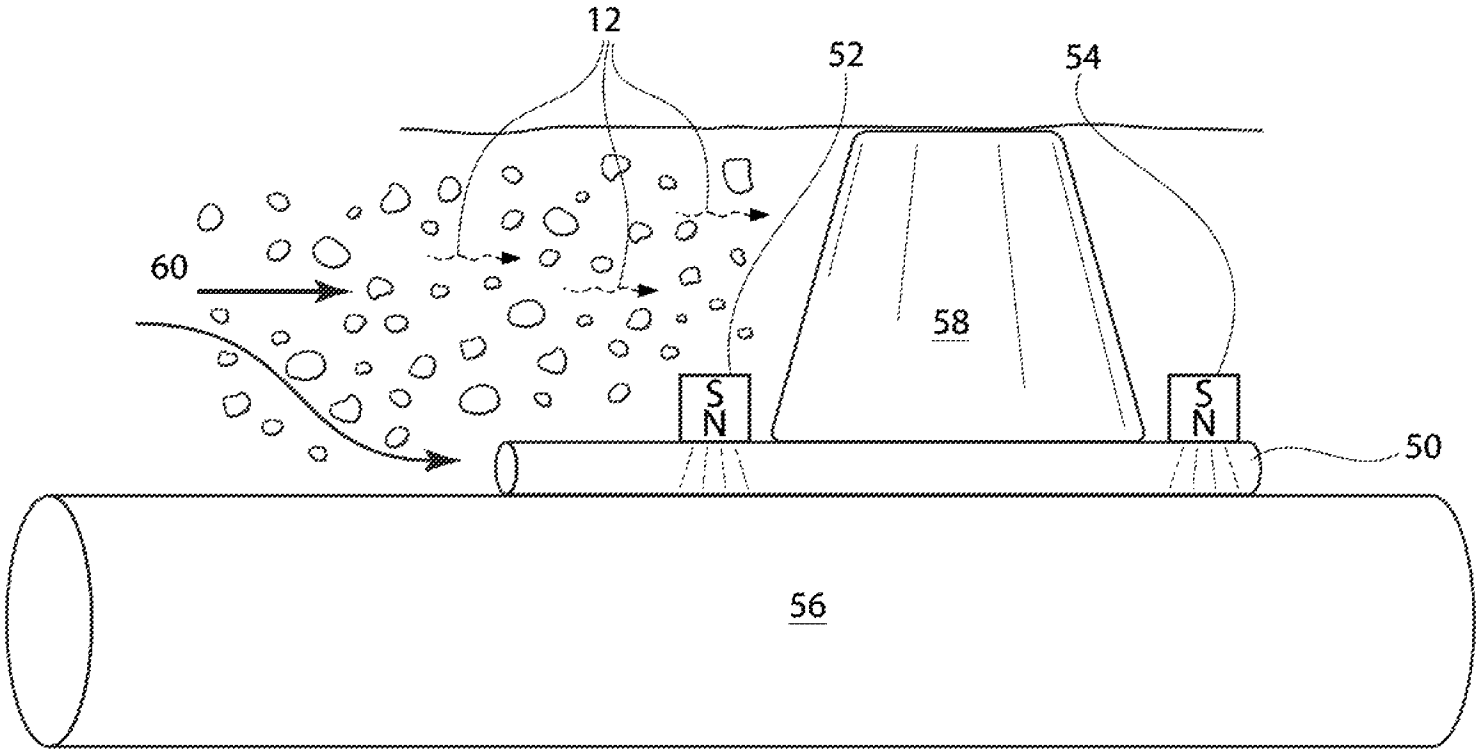
FIG. 19 shows a side view of a shunt tube having magnets pre-placed alongside.

The aspects described herein may be used to block or seal other parts of the completion. For example, FIG. 19 shows a side view of a shunt tube 50 having magnets 52, 54 pre-placed adjacent thereto. The shunt tube 50 is shown positioned generally parallel to the completion string 56 with a packer element 58 in place. A gravel pack 60 is also in place. The shunt tube 50 is generally used as an underpass below the packer 58. It is desirable to have the shunt tube 50 open and flowing for the gravel pack process, but it may be desirable to plug the shunt tube 50 once the gravel pack 60 has been placed. In this case, magnets 52, 54 positioned directly on the shunt tube 50 may slow carrier fluid 12 that can be delivered along with (or through) the gravel pack. This carrier fluid 12 may be referred to as gravel-laden fluid in this instance. The gravel-laden carrier fluid 12 is allowed to pass through the shunt tube 50, but caused to stop due to magnetic forces between the magnetically responsive particles in the fluid 12 and the magnets 52, 54 on the shunt tube 50. This would effectively block the shunt tube 50 from conveying further fluids.

The aspects described herein may also be used to deliver any type of working fluid downhole. For example, the tool 10 may be used to deliver magnetorheological acids that could be used to dissolve plugs, to provide pinpoint well stimulation, to clean perforations, or any other uses. This disclosure is not intended to limit the alternative fluids that may be delivered in any way. For example, in one variation, a first fluid could be injected into an AICD/ICD to shut-off flow through the device. This first fluid may be used to create complete water blockage. After time, a second fluid can be injected into the AICD/ICD to remove the first fluid. This would return flow through the screen section. Alternatively, the second fluid could be used to dissolve a bypass around the AICD/ICD and return flow through the screen section.

The remedial process described generally use magnets to constrain the fluid and to direct the fluids toward the area that needs sealing or desired treatment. This disclosure also allows a user to create a pinpoint placement of fluid in an already-existing wellbore. The magnets are used to constrain the fluid and to direct the fluid to its target location. This approach includes adding magnetically responsive or ferromagnetic particles to a carrier fluid so that the resulting magnetorheological fluid interacts with the magnets on a service tool or elsewhere. The result is a targeted stimulation, a targeted acid job, or a targeted placement of chemical such as a scale inhibiter or any other working fluid to be delivered downhole.

In one aspect, there is provided an intervention tool for use downhole in a wellbore, comprising a tool shaft; at least two magnets positioned with respect to the tool shaft; a carrier fluid comprising a polymer precursor and magnetically responsive particles; one or more injection ports on the tool shaft; a fluid deployment system to cause deployment of the carrier fluid out of the tool shaft through the one or more injection ports.

In a further aspect, there is provided a method for constraining a sealant to create a remedial repair patch in a downhole well, comprising: providing a radially extending magnetic force field; providing a magnetorheological carrier fluid with a polymer precursor component that cures to form a sealant; dispensing the magnetorheological fluid such that the fluid is constrained by the magnetic force field, allowing the fluid to cure to form to form a remedial repair patch.

The foregoing description, including illustrated aspects and examples, has been presented only for the purpose of illustration and description and is not intended to be exhaustive or to limiting to the precise forms disclosed. Numerous modifications, adaptations, and uses thereof will be apparent to those skilled in the art without departing from the scope of this disclosure.

What is claimed is:

1. An intervention tool for use downhole in a wellbore, comprising:

a tool shaft;

at least two magnets positioned with respect to the tool shaft;

a carrier fluid comprising a polymer precursor configured to cross-link, cure, and form a seal and magnetically responsive particles;

one or more injection ports on the tool shaft;

a fluid deployment system to cause deployment of the carrier fluid out of the tool shaft through the one or more injection ports, wherein the at least two magnets comprise ring magnets positioned on an outer diameter of the tool shaft.

2. The intervention tool of claim 1, wherein a magnetic field from the at least two magnets comprises a radially extending magnetic field that directs the magnetically responsive particles to seal a space in need of a remedial repair.

3. The intervention tool of claim 1, wherein the carrier fluid is a non-cement sealant that cures and hardens to set, creating a secure seal.

4. The intervention tool of claim 1, wherein the carrier fluid comprises at least one of a plastic, adhesive, thermoplastic, thermosetting resin, elastomeric material, polymer, epoxy, silicone, sealant, oil, gel, glue, acid, thixotropic fluid, dilatant fluid, or any combination thereof.

5. The intervention tool of claim 1, wherein the magnetically responsive particles comprise nanoparticles.

6. The intervention tool of claim 1, wherein the magnetically responsive particles comprise iron, nickel, cobalt, diamagnetic particles, paramagnetic particles, ferromagnetic particles, or any combination thereof.

7. The intervention tool of claim 1, wherein the carrier fluid comprises a silicone and wherein the magnetically responsive particles comprise iron particles.

8. The intervention tool of claim 1, wherein the intervention tool is used for a remedial repair to fix one or more damaged screens, to block a water producing zone, to block inflow through an in-flow control device or an autonomous in-flow control device to provide permanent fluid flow stoppage, to block inflow through a screen section, to deliver targeted stimulation, a targeted acid job, targeted placement of a chemical, or targeted delivery of a magnetorheological acid.

9. A method for constraining a sealant to create a remedial repair patch in a downhole well, comprising:

providing a radially extending magnetic force field;

providing a magnetorheological carrier fluid with a polymer precursor component that cures to form a sealant;

dispensing the magnetorheological fluid such that the fluid is constrained by the magnetic force field, allowing the fluid to cure to form to form a remedial repair patch, wherein the magnetic force field is provided on a service tool.

10. The method of claim 9, wherein the service tool is used for a remedial repair to fix one or more damaged screens.

11. The method of claim 9, wherein the service tool is used for blocking a water producing zone.

12. The method of claim 9, wherein the service tool is used for blocking inflow through an in-flow control device or an autonomous in-flow control device to provide permanent fluid flow stoppage.

13. The method of claim 9, wherein the service tool is used for blocking inflow through a screen section to provide fluid flow stoppage.

14. The method of claim 9, wherein the service tool is used for targeted stimulation, a targeted acid job, targeted placement of a chemical, or targeted delivery of a magnetorheological acid.

15. The method of claim 9, wherein the magnetic force field is provided on a well completion.

16. An intervention tool for use downhole in a wellbore, comprising:

a tool shaft;

at least two magnets positioned with respect to the tool shaft;

a carrier fluid comprising a polymer precursor configured to cross-link, cure, and form a seal and magnetically responsive particles;

one or more injection ports on the tool shaft;

a fluid deployment system to cause deployment of the carrier fluid out of the tool shaft through the one or more injection ports, wherein the fluid deployment system comprises a piston powered by a downhole power unit, an electronic rupture disc, hydrostatic pressure, or a hydraulic pump.

17. The intervention tool of claim 16, wherein a magnetic field from the at least two magnets comprises a radially extending magnetic field that directs the magnetically responsive particles to seal a space in need of a remedial repair.

18. The intervention tool of claim 16, wherein the carrier fluid is a non-cement sealant that cures and hardens to set, creating a secure seal.

19. The intervention tool of claim 16, wherein the carrier fluid comprises at least one of a plastic, adhesive, thermoplastic, thermosetting resin, elastomeric material, polymer, epoxy, silicone, sealant, oil, gel, glue, acid, thixotropic fluid, dilatant fluid, or any combination thereof.

20. The intervention tool of claim 16, wherein the magnetically responsive particles comprise nanoparticles.

21. The intervention tool of claim 16, wherein the magnetically responsive particles comprise iron, nickel, cobalt, diamagnetic particles, paramagnetic particles, ferromagnetic particles, or any combination thereof.

22. The intervention tool of claim 16, wherein the carrier fluid comprises a silicone and wherein the magnetically responsive particles comprise iron particles.

23. The intervention tool of claim 16, wherein one magnet is secured on one side of the injection port and another magnet is secured on another side of the injection port.

24. The intervention tool of claim 16, wherein the intervention tool is used for a remedial repair to fix one or more damaged screens, to block a water producing zone, to block inflow through an in-flow control device or an autonomous in-flow control device to provide permanent fluid flow stoppage, to block inflow through a screen section, to deliver targeted stimulation, a targeted acid job, targeted placement of a chemical, or targeted delivery of a magnetorheological acid.

* * * * *